US010433602B2

(12) United States Patent
Kim

(10) Patent No.: US 10,433,602 B2
(45) Date of Patent: Oct. 8, 2019

(54) STRAP FASTENING DEVICE

(71) Applicant: Sug Whan Kim, Gimpo-si (KR)

(72) Inventor: Sug Whan Kim, Gimpo-si (KR)

( * ) Notice: Subject to any disclaimer, the term of this patent is extended or adjusted under 35 U.S.C. 154(b) by 0 days.

(21) Appl. No.: 15/735,260

(22) PCT Filed: Jun. 10, 2016

(86) PCT No.: PCT/KR2016/006193
§ 371 (c)(1),
(2) Date: Dec. 11, 2017

(87) PCT Pub. No.: WO2016/200209
PCT Pub. Date: Dec. 15, 2016

(65) Prior Publication Data

US 2018/0168259 A1 Jun. 21, 2018

(30) Foreign Application Priority Data

Jun. 12, 2015 (KR) ..... 10-2015-0083287

(51) Int. Cl.
*B65H 75/44* (2006.01)
*A43C 11/16* (2006.01)
(Continued)

(52) U.S. Cl.
CPC ..... *A41F 1/00* (2013.01); *A43C 11/00* (2013.01); *A43C 11/16* (2013.01); *B65H 75/00* (2013.01);
(Continued)

(58) Field of Classification Search
CPC ..... A43C 11/16; A43C 11/165; A43C 7/00; A45C 13/10; A45C 13/1046; B65H 54/00; B65H 54/02; B65H 55/043; B65H 65/00; B65H 69/00; B65H 75/00; B65H 75/40; B65H 75/406; B65H 75/4494; B65H 75/30; B65H 75/34; B65H 75/4471; B65H 75/4481; B65H 75/4492; B65H 75/38; B65H 75/02; B65H 75/14; B65H 75/141; B65H 75/148; B65H 75/241; B65H 16/00;
(Continued)

(56) References Cited

U.S. PATENT DOCUMENTS 3,738,027 A * 6/1973 Schoch ..... A43B 1/0054 24/68 R
4,433,456 A * 2/1984 Baggio ..... A43C 11/16 24/68 B
(Continued)

FOREIGN PATENT DOCUMENTS

KR 20-0293776 11/2002
KR 20-0361265 9/2004
(Continued)

*Primary Examiner* — Michael R Mansen
*Assistant Examiner* — Raveen J Dias
(74) *Attorney, Agent, or Firm* — Lex IP Meister, PLLC

(57) ABSTRACT

A string fastening device which may be used for easily winding and fastening strings provided in shoes, bags, clothes, or the like is provided. The string fastening device includes a base; a fixation member coupled to the base to maintain state in which the bobbin is stored in the base; a rotational member coupled to the fixation member and rotating the bobbin; and a string suspension member provided in the bobbin and fixing a string.

17 Claims, 18 Drawing Sheets

(51) Int. Cl.

| | |
|---|---|
| ***A43C 11/00*** | (2006.01) |
| ***B65H 75/34*** | (2006.01) |
| ***A43C 7/00*** | (2006.01) |
| ***B65H 75/00*** | (2006.01) |
| ***A41F 1/00*** | (2006.01) |
| *A41F 1/06* | (2006.01) |
| *A45C 13/10* | (2006.01) |
| *A45F 3/04* | (2006.01) |
| *A45F 3/00* | (2006.01) |
| *A43C 7/08* | (2006.01) |

(52) U.S. Cl.
CPC ..... *B65H 75/4471* (2013.01); *A41F 1/06* (2013.01); *A43C 7/00* (2013.01); *A43C 7/08* (2013.01); *A43C 11/165* (2013.01); *A45C 13/10* (2013.01); *A45F 3/04* (2013.01); *A45F 2003/001* (2013.01); *B65H 75/34* (2013.01)

(58) Field of Classification Search
CPC ..... B65H 18/00; B65H 59/00; B65H 59/38; A41F 1/00; A41F 1/06; A41F 3/04
USPC ..... 36/50.1, 50.5; 24/68 R, 69 WT; 242/388.1
See application file for complete search history.

(56) References Cited

U.S. PATENT DOCUMENTS 5,325,613 A * 7/1994 Sussmann ..... A43C 11/00 24/712.2
6,502,286 B1 * 1/2003 Dubberke ..... A43C 7/00 24/712.1
9,717,305 B2 * 8/2017 Midorikawa ..... A43C 11/165
2002/0095750 A1 * 7/2002 Hammerslag ..... A43B 5/16 24/68 SK
2007/0084956 A1 * 4/2007 Chen ..... A43C 7/00 242/388.6
2010/0139057 A1 * 6/2010 Soderberg ..... A43C 11/16 24/68 R
2011/0266384 A1 * 11/2011 Goodman ..... A43C 11/165 242/396.4
2011/0303782 A1 * 12/2011 Hu ..... A43C 11/165 242/388
2013/0092780 A1 * 4/2013 Soderberg ..... A43C 11/165 242/396.4
2014/0097283 A1 * 4/2014 So ..... A44B 99/00 242/404
2014/0359981 A1 * 12/2014 Cotterman ..... A43C 11/20 24/712.9
2015/0059206 A1 * 3/2015 Lovett ..... A43C 11/165 36/50.1
2016/0120267 A1 * 5/2016 Burns ..... A44B 11/065 24/68 C
2018/0035761 A1 * 2/2018 Midorikawa ..... A43C 11/20

FOREIGN PATENT DOCUMENTS

| | | |
|---|---|---|
| KR | 10-0986674 | 10/2010 |
| KR | 10-1025134 | 3/2011 |
| KR | 10-1028468 | 4/2011 |
| KR | 10-2013-0100238 | 9/2013 |
| KR | 10-2014-0065417 | 5/2014 |
| KR | 10-2015-0032516 | 3/2015 |

* cited by examiner

STRAP FASTENING DEVICE

TECHNICAL FIELD

The present invention relates to a string fastening device which can be used to easily fasten a string provided in various consumer goods or industrial products including shoes, bags, clothes, and the like.

BACKGROUND ART

In general, consumer goods to be worn, such as shoes, bags, backpacks, gloves, and clothes can be provided with string fastening devices which are tightened or loosened by using a string.

The string fastening devices in the related art have a structure in which the string passes through a hole provided therein and fastened or permanently fixed so that the string and the string fastening device are integrally combined.

Such a string fastening device has a problem in that it is difficult to separate the string from the string fastening device and an operation of mounting and fixing the string is also inconvenient, resulting in lowering merchantability.

In addition, in the related art, since the string fastening device is sold while being mounted on industrial products in a state where the string is already installed in the string fastening device in the industrial products such as shoes, bags, backpacks, gloves, and clothes, there is still a problem in that there is inconvenience that the string is fastened or loosen by hands

DISCLOSURE

Technical Problem

Accordingly, the present invention has been made in an effort to provide a new string fastening device in which a string to be fastened can be conveniently used while being fixed to a string fastening device, use convenience is achieved and merchantability is enhanced.

The present invention has also been made in an effort to provide a new string fastening device which can be easily installed and used in various industrial products including shoes, bags, backpacks, gloves, and clothes which are released without the string fastening device in the related art.

Technical Solution

An exemplary embodiment of the present invention provides a string fastening device including: a base; a fixation member coupled to the base to maintain state in which the bobbin is stored in the base; a rotational member coupled to the fixation member and rotating the bobbin; and a string suspension member provided in the bobbin and fixing a string.

The string suspension member may be provided in the bobbin, may be opened so that the string moves while the string is inserted, and may maintain the string to be fixed when the string stops to move The string suspension member may include a string attachment portion which is provided in the bobbin and is bent in a direction away from a direction of a center line of a hole into which the string is inserted when the string is inserted and fixes the string as restoring elastic force is applied toward the center line when the string stops to be inserted.

At least one string suspension member may be disposed in the bobbin.

In the bobbin, an insertion groove may be provided in a radial direction based on a rotation center and the string suspension member may be disposed in the insertion groove.

The insertion groove may be connected with the hole into which the string is inserted.

The hole through which the string passes may be provided in the bobbin, and the string suspension member may include a location fixing portion disposed in the bobbin, and the string attachment portion extended to be inclined toward the center line of the hole from the location fixing portion and attached to the string by the elastic force.

In the string attachment portion, when the string is inserted into the hole, an end portion of the string attachment portion may move in a direction away from the center line of the location fixing portion.

In the string attachment portion, when the string is inserted into the hole, the end portion of the string attachment portion may move to a side where the location fixing portion is disposed.

The location fixing portion may have a substantially ring shape having a through-hole of which an inner part is penetrated at the center and the string may be inserted into the through-hole positioned at the center of the ring.

The location fixing portion may be made of an elastic body.

The string suspension member may be made of a leaf spring of which a part is bent.

The bobbin may be divided into a first member and a second member, which fitted and fixed to each other. Between the fixation member and the rotational member, a one-direction rotational means in which the rotational member rotates only in one direction, that is, a winding direction when bobbin winds the string is provided.

The one-direction rotational means may include a first suspension portion provided in the fixation member, and a second suspension portion corresponding to the first suspension portion and provided in the rotational member, and when the first suspension and the second suspension portion are in contact with each other, the rotational member may rotatably moves only in one direction and reverse rotation of the rotational member may be restricted.

In the fixation member, a first space portion partitioned by a suspension step having elasticity, such as a flexure and a second space portion adjacent to the first space portion and disposed in an axial direction may be provided on an inner circumferential surface, and a suspension extension portion provided on the inner circumferential surface of the rotational member may be fitted into the first or second space portion.

In the bobbin, a first coupling portion may be provided, and a second coupling portion coupled to the first coupling portion and transferring force to rotate the bobbin may be provided in the rotational member.

In the string suspension member, the hole into which the string is inserted may be provided in the bobbin, and the string attachment portion extended from one side of the hole and attaching and fixing the string by the elastic force may be provided.

Advantageous Effects

According to an exemplary embodiment of the present invention, a string fastening device can be provided separately from the string fastening device. and when a user holds each end of strings to be fastened and inserts each end it into a hole provided in a bobbin, the string is suspended on a string suspension member to easily maintain a fixed state and the string can be fastened while the string is wound on the bobbin by a winding operation in which a user rotates a rotational member, it is convenient to use the string fastening device.

Further, according to the exemplary embodiment of the present invention, since the string fastening device can be easily installed and used in shoes, bags, backpacks, gloves, and clothes in which the string fastening device is not permanently installed, merchantability can be increased.

MODE FOR INVENTION

Figure 1:
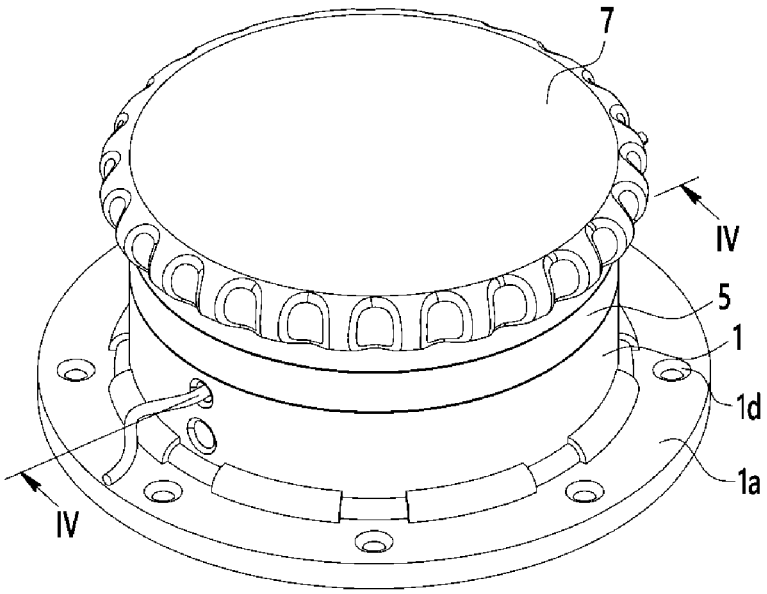
FIG. 1 is a perspective view illustrating a string fastening device in order to describe a first example of an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. Parts not associated with required description are omitted for clearly describing the present invention and like reference numerals designate like elements throughout the specification.

Figure 2:
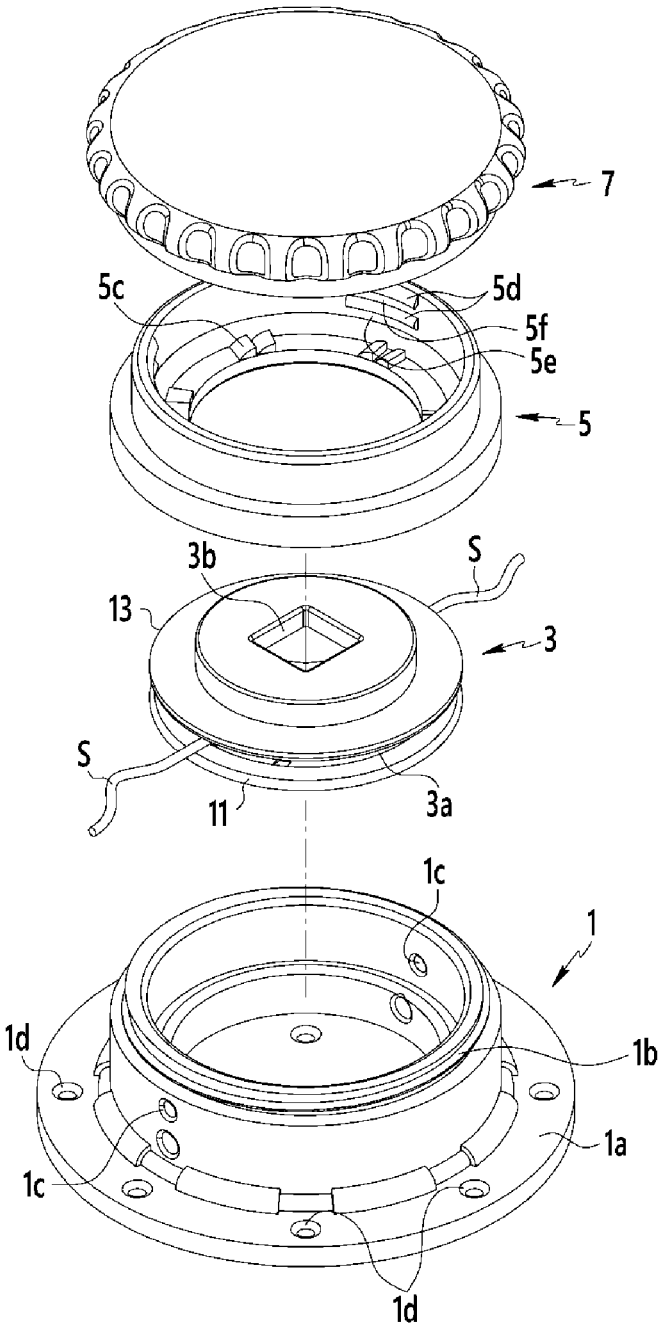
FIG. 2 is an exploded perspective view of FIG. 1.
Figure 3:
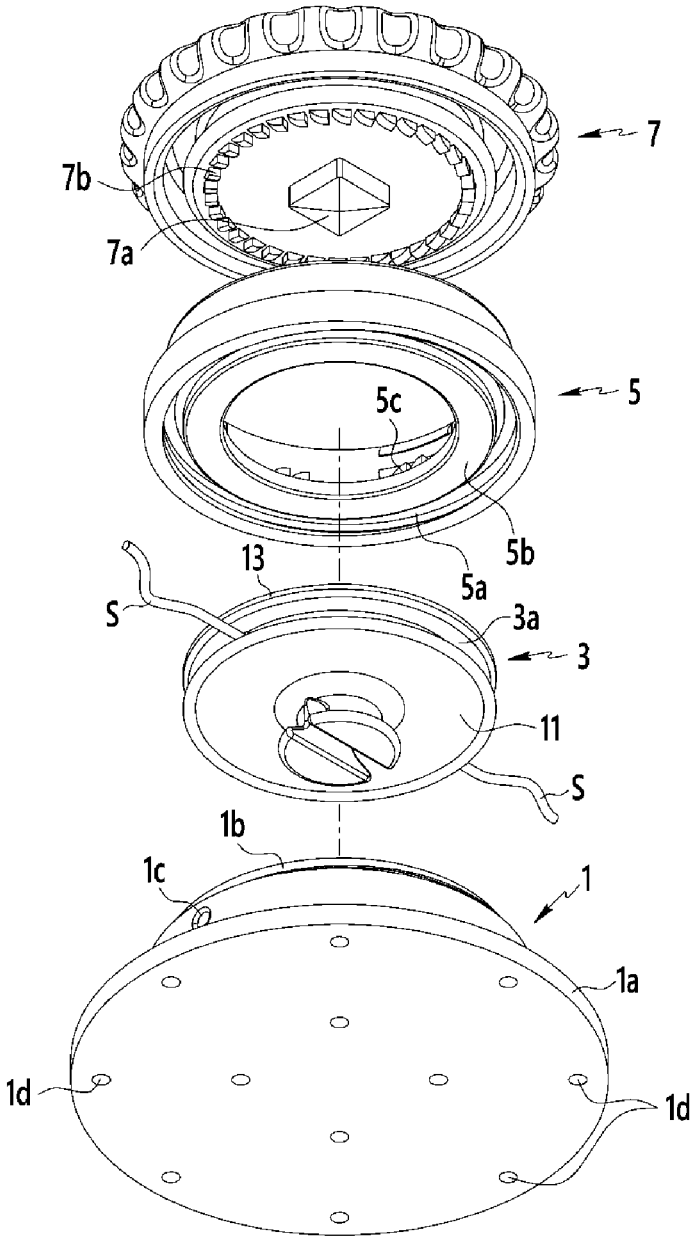
FIG. 3 is an exploded perspective view of the string fastening device of FIG. 2 as viewed from the bottom side.
Figure 4:
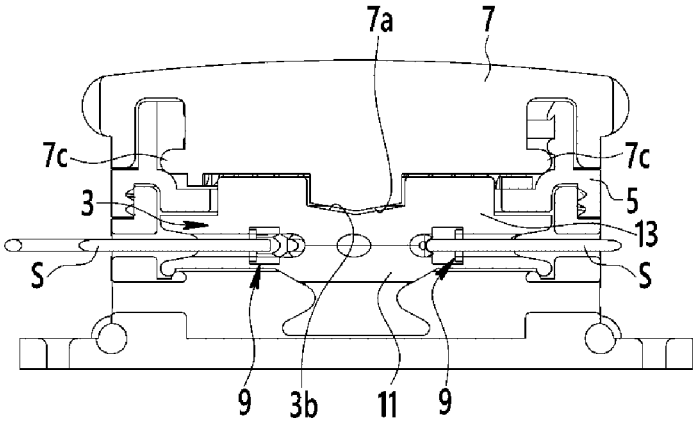
FIG. 4 is a cross-sectional view taking along line IV-IV of FIG. 1.

FIG. 1 is a perspective view for describing a first example of an exemplary embodiment of the present invention, FIG. 2 is an exploded perspective view of a main part of FIG. 1, FIG. 3 is a bottom exploded perspective view of FIG. 2, and FIG. 4 is a cross-sectional view taking along line IV-IV of FIG. 1 and illustrates a string fastening device of the present invention.

The string fastening device of the exemplary embodiment of the present invention includes a base 1, a bobbin 3, a fixation member 5, a rotational member 7, and a string suspension member 9.

The base 1 is provided with a space therein and may be formed in a cylinder or a tube shape, and a flange portion attachment portion may be provided on the bottom side (based on FIG. 3). A threaded portion 1*b* may be provided on an outer circumferential surface of the base 1. The fixation member 5 may be coupled to the threaded portion 1*b* provided to the base 1. Herein, the threaded portion 1*b* is an example of one method of coupling the base 1 and the fixation member 5 and in fact, the method of coupling the base 1 and the fixation member 5 may include all normal methods that may couple two objects such as a clip (not illustrated), a hook (not illustrated), a screw or a bolt and a nut (not illustrated), etc. String insertion holes 1*c* through which strings S pass may be provided on the side of the base 1 while facing each other. For example, an end portion of the string S such as a sneaker string may be inserted into the string insertion hole 1*c*. As another example of the exemplary embodiment of the present invention, a string insertion groove such as a slit (not illustrated) provided in an axial direction may be provided instead of the string insertion hole 1*c*. Such a slit type string insertion groove may be formed by the slit having an opening which is opened in the axial direction.

Meanwhile, a flange portion attachment portion of the base 1 may be provided with multiple fixation holes 1*d* penetrating in a direction parallel to an axis. The fixation hole 1*d* is used for fixing the string fastening device to an article using the string, such as a shoe (described as an example).

The user may fix the string fastening device to for example, a sneaker, or the like using a middle portion of the string S which needs to be fastened to the fixation hole 1*d* and mount the string fastening device of the present invention by inserting a separate mounting string from the string S which needs to be fastened into the fixation hole 1*d*.

The bobbin 3 may be disposed in an inner space of the base 1. The bobbin 3 is a place on which the string S is wound and may rotate together with the rotational member 7. An elastic body (not illustrated) acting as a spring may be installed on the bobbin 3 by connecting a part of the bobbin 3 and a part of the base 1 in a state of being coupled to the base 1.

A winding groove 3*a* in which the string S is wound may be provided on the outer circumferential surface of the bobbin 3. A first coupling portion 3*b* may be provided on a surface of the bobbin 3, which faces the rotational member 7 in the axial direction. The first coupling portion 3*b* provided to the bobbin 3 may be formed by a square groove or be formed by a groove having various shapes such as a polygonal shape, asymmetric elliptical shape, or a slot shape.

The first coupling portion 3*b* may be formed by a spline groove into which a spline shaft may be fitted in some cases or vice versa, the first coupling portion 3*b* may be formed by a spline shaft. Further, the first coupling portion 3*b* may be formed by one or more protrusions or grooves disposed at a predetermined interval. When any one of the first coupling portion 3*b* of the bobbin 3 and a second coupling portion 7*a* of the rotational member 7 to be described below has a protrusion shape, the other one has a groove shape, and as a result, the first coupling portion 3*b* and the second coupling portion 7*a* may be provided to be fitted to each other. The fixation member 5 may be coupled to the threaded portion 1*b* provided on the base 1 by providing a threaded groove 5*a* (see FIG. 3) on an inner circumferential surface thereof. Herein, a thread groove 5*a* is an example of one method of coupling the base 1 and the fixation member 5 and in fact, the method of coupling the base 1 and the fixation member 5 may include all normal methods that may couple two objects such as the clip (not illustrated), the hook (not illustrated), the screw or bolt and nut (not illustrated), etc.

The fixation member 5 has a structure in which the fixation member 5 penetrates in the axial direction. The fixation member 5 is disposed in a state in which the bobbin 3 is rotatable in the base 1 while being coupled to the base 1. That is, the fixation member 5 is provided with an extension portion 5*b* (see FIG. 3) having a part of the inner circumferential surface extending to the center side so as to support the bobbin 3 so as not to be detached in the axial direction.

The fixation member 5 is provided with multiple first suspension portions 5*c* in a circumferential direction on the surface of the extending portion 5*b*, which faces the rotational member 7. The first suspension portion 5*c* may protrude in the circumferential direction, and have one side which is inclined. The shape of the first suspension portion 5*c* allows the rotational member 7 to rotate smoothly in one direction in some cases. In another example of the exemplary embodiment of the present invention, the first suspension portion 5*c* provided on the fixation member 5 may be disposed on the inner circumferential surface of the fixation member 5. Another example of such an exemplary embodiment of the present invention means that the first suspension portion 5*c* of the fixation member 5 may be disposed at various locations for convenience of design. Of course, when the first suspension portion 5*c* of the fixation member 5 is disposed on the inner circumferential surface of the fixation member 5, the second suspension portion 7*b* may be disposed at a location of the rotational member 7 which corresponds thereto. The fixation member 5 is provided with a suspension step 5*d* (see FIG. 2) in the circumferential direction on the inner circumferential surface thereof. The suspension step 5*d* may be provided in two stages in the axial direction and a first space portion 5*e* and a second space portion 5*f* may be provided between the suspension steps 5*d* provided in two stages. The first space portion 5*e* and the second space portion 5*f* may be continuously arranged in the axial direction with the suspension step 5*d* interposed therebetween. A suspension extension portion 7*c* of the rotational member 7 may rotate while being fitted into the first space portion 5*e* or the second space portion 5*f*. The suspension step 5*d* of the fixation member 5 may be made of an elastic body having excellent restoring force and a part of the suspension extension portion 7*c* of the rotational member 7 may also be made of an elastic body having the excellent restoring force. For example, the portions of the suspension step 5*d* and the suspension extension portion 7*c*, which may be made of the elastic body may be formed in various shapes by cutting, bending, or curving a leaf spring or a wire-formed line spring.

The rotational member 7 may be coupled to the first coupling portion 3*b* of the bobbin 3 by providing the second coupling portion 7*a* in the axial direction as illustrated in FIG. 3. The second coupling portion 7*a* of the rotational member 7 is formed in a shape that may be fitted into the first coupling portion 3*b* of the bobbin 3. Therefore, when the rotational member 7 is rotated, the bobbin 3 may rotate together. That is, the second coupling portion 7*a* may be formed by at least one protrusion or at least one groove corresponding to the first coupling portion 3*b* and formed by the spline shaft (not illustrated) or the spline groove (not illustrated). The second coupling portion 7*a* of the rotational member 7 may adopt all coupling portions formed in a structure in which the bobbin 3 may rotate together when the rotational member 7 is rotated by fitting the second coupling portion 7*a* into the first coupling portion 3*b* of the bobbin 3. In another example of the exemplary embodiment of the present invention, the first coupling portion 3*b* and the second coupling portion 7*a* may be replaced by a component such as a one-direction clutch or a component such as the one-direction clutch. The rotating member 7 may be provided with the second suspension portion 7*b* corresponding to the first suspension portion 5*c* of the fixation member 5 (see FIG. 3). The second suspension portion 7*b* provided in the rotational member 7 may also be provided in the circumferential direction and one side may be provided with an inclined surface. The first suspension portion 5*c* of the fixation member 5 and the second suspension portion 7*b* of the rotational member 7 come into contact with each other so as to allow the rotational member 7 to rotate only in one direction, that is, a direction in which the string is fastened and prevent the rotational member 7 from rotating in a reverse direction thereto, that is, a direction in which the string is loosen. In the exemplary embodiment of the present invention, the case where the rotational member 7 rotates only in one direction may mean that the bobbin 3 rotates only in one direction.

In the exemplary embodiment of the present invention, the rotational member 7 is a one-direction rotational means which rotatably moves only in one direction and protrusion structures such as the first suspension portion 5*c* and the second suspension portion 7*b* are exemplified, but a component such as a one-direction clutch bearing may be used. That is, even though the first suspension portion 5*c* and the second suspension portion 7*b* are omitted and the member such as the one-direction clutch bearing is installed between the fixation member 5 and the rotational member 7 is installed, the same or similar action as the exemplary embodiment of the present invention may be obtained. In the exemplary embodiment of the present invention, the one-direction rotational may just adopt a means having various structures, which allows the rotational member 7 to rotate only in one direction and prevents the rotational member 7 from rotating in a reverse direction thereto. As one example, the first suspension portion 5*c* and the second suspension portion 7*b* may be provided as a left spring or a wire-formed elastic body having various protrusion and groove shapes.

As another example of the exemplary embodiment of the present invention, a bar (not illustrated) of the elastic body may be applied to the second suspension portion 7*b*. That is, the bar of the elastic body coupled to the rotational member 7 may be in contact with the first suspension portion 5*c* to perform the one-direction rotation function described above. Of course, the first suspension portion 5*c* may be formed by the bar (not illustrated) of the elastic body and formed in a protrusion structure in which the second suspension portion 7*b* corresponding to the first suspension portion 5*c* protrudes. In addition, the rotational member 7 is provided with the suspension extension portion 7*c* (see FIG. 4) radially based on a rotation center on the inner circumferential surface.

The suspension extension portion 7*c* provided on the rotational member 7 presses the suspension step 5*d* having elasticity by a pushing or pulling action of the user and moves across the suspension step 5*d* to be inserted into the first space portion 5*e* or the second space portion 5*f* of the fixation member 5. Therefore, the rotational member 7 may rotate while maintaining a state in which the rotational member 7 is coupled to the fixation member 5. In particular, when the suspension extension portion 7*c* of the rotational member 7 is positioned in the first space portion 5*e* of the fixation member 5, the first suspension portion 5*c* of the fixation member 5 and the second suspension portion 7*b* of the rotational member 7 are in contact with each other and the rotational member 7 rotates only in one direction to fasten the string S. When the suspension extension portion 7*c* of the rotational member 7 is positioned in the second space portion 5*f* of the fixation member 5, the second coupling portion 7*a* of the rotational member 7 is separated from the first coupling portion 3*b* and the first suspension portion 5*c* of the fixation member 5 and the second suspension portion 7*b* of the rotational member 7 are separated from each other, and as a result, the rotational member 7 may autonomously rotate in both directions, but rotation of the rotational member 7 does not induce rotation of the bobbin 3.

While the suspension extension portion 7*c* of the rotational member 7 moves in the axial direction across the suspension step 5*d* (meaning the suspension step disposed at the bobbin 3 based on the axial direction) having elasticity by an operation of pulling or pushing the rotational member 7 in the axial direction by the user, a location of the suspension extension portion 7*c* may be changed between the first space portion 5*e* and the second space portion 5*f*. The suspension step 5*d* may be formed integrally with the fixation member 5 and may be formed by coupling a separate elastic body to the fixation member 5.

Further, handle grooves may be provided on the outer circumferential surface of the rotational member 7 at an interval. That is, the handle groove or a bottom circumferential surface may be provided on the outer circumferential surface so that the user conveniently rotates the rotational member 7 with a hand. The rotational member 7 may serve as both a handle and a cover of the string fastening device.

Figure 5:
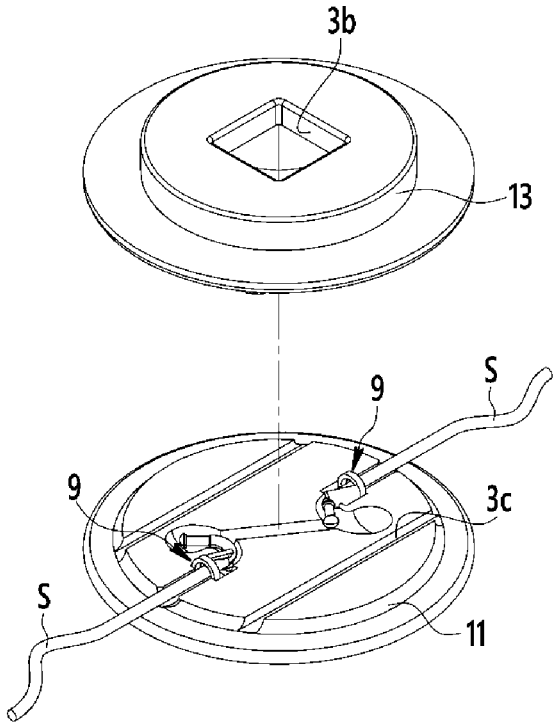
FIG. 5 is an exploded perspective view illustrating a bobbin of the first example of the exemplary embodiment of the present invention.
Figure 6:
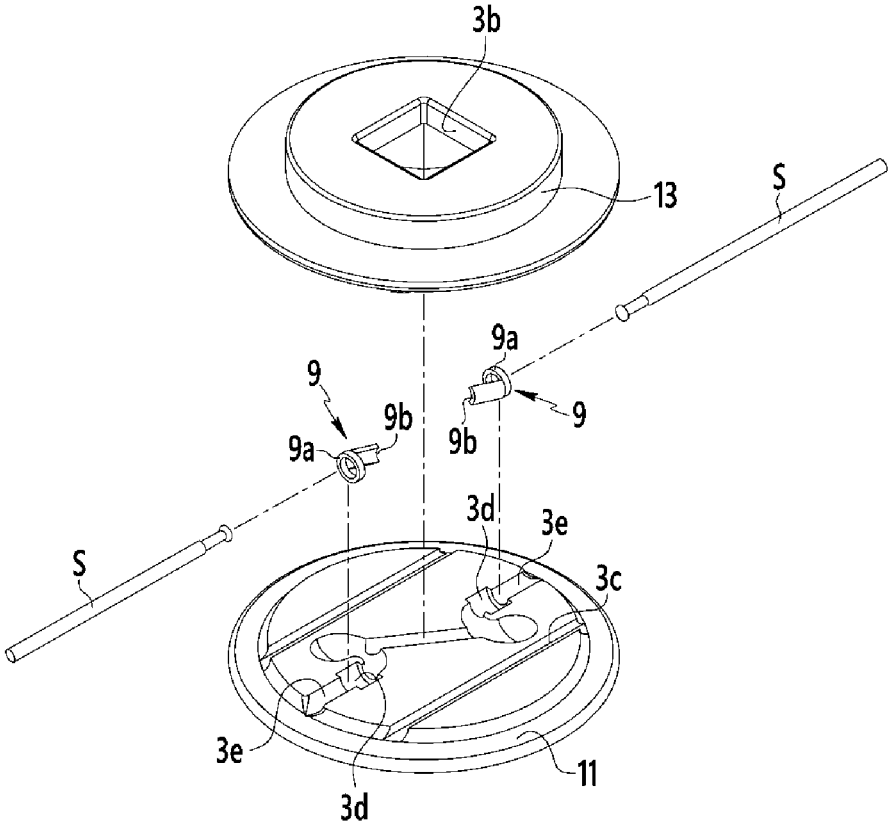
FIG. 6 is an exploded perspective view illustrating and disassembling a main part of FIG. 5.

FIGS. 5 and 6 are exploded perspective views for describing a first example of the exemplary embodiment of the present invention and illustrate the bobbin 3.

The bobbin 3 may be coupled by fitting first and second members 11 and 13 into each other. The first member 11 of the bobbin 3 may be provided with a groove 3*c* which is dented in the axial direction and the second member 13 may be provided with a protrusion (not illustrated) which protrudes in the axial direction so as to be fitted into the groove 3*c*. Accordingly, the first and second members 11 and 13 provided so that one of two has the groove 3*c* and the other one has the protrusion are coupled to each other in the axial direction to be used as one component.

The bobbin 3 may be provided with an insertion groove 3*d* in which the string suspension member 9 may be received in a radial direction from the rotation center toward the outer circumferential surface of the bobbin 3. The insertion groove 3*d* provided in the bobbin 3 may be a groove which is dented in the radial direction from the rotation center of the bobbin 3. The insertion groove 3*d* of the bobbin 3 may be connected to a hole 3*e* into which the string S is inserted.

The insertion groove 3*d* into which the string suspension member 9 is inserted has a larger diameter than the hole 3*e* into which the string S is inserted so that the string suspension member 9 may be fixed to the inside of the insertion groove 3*d*. Of course, the hole 3*e* provided in the bobbin 3 and into which the string S is inserted may also be provided in the radial direction based on the rotation center of the bobbin 3. In particular, the holes 3*e* provided in the bobbin 3 and into which the string S is inserted may be arranged in a straight line with each other. The hole 3*e* provided in the bobbin 3 and into which the string S is inserted may also be formed of a slit type string insertion groove (not illustrated) provided in the axial direction as another example. Such a slit type string insertion groove may be formed by the slit having an opening which is opened in the axial direction. The string insertion groove constituted by the hole 3*e* and the slit may be referred to as a hole portion.

As illustrated FIGS. 5 and 6, the string suspension member 9 of the first example of the exemplary embodiment of the present invention includes a location fixing portion 9*a* and a string attachment portion 9*b*. In the first example of the exemplary embodiment of the present invention, the location fixing portion 9*a* may have a substantially ring shape, and the ring shape may be a closed curved surface or may be an open ring shape in which a part of the ring shape is open. The string attachment portion 9*b* may be made of the elastic body extending in a tilted state in the center direction at the location fixing portion 9*a*. The string attachment portion 9*b* may be made of a material having excellent elasticity and may be integrally formed with the location fixing portion 9*a*. The string attachment portion 9*b* may closely attach the side of the string S inserted through the hole 3*e* of the bobbin 3 with elastic force. That is, the ring-shaped location fixing portion 9*a* is inserted into the insertion groove 3*d* of the bobbin 3 to maintains a state in which the location fixing portion 9*a* is fixed to the bobbin 3 and the string attachment portion 9*b* is attached to the string S to press the string S toward an inner wall surface of the hole 3*e*, thereby preventing the string S from being escaped from the hole 3*e*.

A process using the string fastening device of the first example of the exemplary embodiment of the present invention and an operation process of the process will be described below in detail.

First, the user inserts the end portion of the string S into the string insertion hole 1*c* provided on the side of the base 1. In this case, if one end portion of the string S is already fixed or if the other end portion or both end portions of the string S is used, the both end portions are inserted into respective string insertion holes 1*c* provided in directions facing each other. Then, the string S passes through the hole 3*e* of the bobbin 3 to penetrate the location fixing portion 9*a* of the string suspension member 9, that is, a ring-shaped central through-hole. Subsequently, when the user pushes the string S, the string S is deeply inserted while being pushed with elasticity outward from a center line of the location fixing portion 9*a*. When the string S is sufficiently inserted through the hole 3*e*, the user releases the string held by the user. Then, while the string attachment portion 9*b* of the string suspension member 9 is moves in the direction of the center line of the location fixing portion 9*a* by the restoring elastic force, a tip end portion of the string attachment portion 9*b* presses the side of the string S toward the inner wall surface of the hole 3*e* (See FIG. 5). Then, the string S may be maintained to be fixed without being escaped from the hole 3*e*. Then, the user continuously holds the rotational member 7 and presses the rotational member 7 in a direction in which the rotational member 7 approaches the fixation member 5.

Then, the suspension extension portion 7*c* of the rotational member 7 rides over the suspension step 5*d* (which means the suspension step disposed on the bobbin side based on the axial direction of FIG. 3) having the elasticity of the fixing member 5 and is disposed in the first space portion 5*e*. In such a state, the user rotates the rotational member 7 in one direction (for example, in a direction in which the string S is wound). Since the second coupling portion 7*a* of the rotational member 7 and the first coupling portion 3*b* of the bobbin 3 are coupled to each other, the bobbin 3 also rotates with rotation of the rotational member 7 rotates. When the bobbin 3 rotates, the string S is wound on a winding groove 3*a* of the bobbin 3 to fasten the string S. According to determination of the user, when the string S is appropriately fastened, rotational movement of the rotational member 7 stops. Then, the first suspension portion 5*c* of the fixation member 5 and the second suspension portion 7*b* of the rotational member 7 are fitted into each other and maintained to be attached to each other. Then, the rotational member 7 is restricted from rotating in the reverse direction and the bobbin 3 is also kept fixed. Therefore, the string S may be kept in a fastening state.

When the string S needs to be released loosely, the user pulls the rotational member 7 in the axial direction in the direction away from the fixation member 5. Then, the second coupling portion 7*a* of the rotational member 7 is separated from the first coupling portion 3*b* and the first suspension portion 5*c* and the second suspension portion 7*b* are also separated from each other while first suspension portion 5*c* and the second suspension portion 7*b* are fitted and attached, and as a result, the rotational member 7 may arbitrarily rotate and the bobbin 3 may also arbitrarily rotate. When an elastic body (not illustrated) such as a spring is separately installed in the bobbin 3 by connecting the bobbin 3 and the base 1 in the bobbin 3, the bobbin 3 moves to an initial location to release the string S wound on the bobbin 3. The fixation member 5 is detached from the base 1 and the first member 11 and the second member 11 of the bobbin 3 are separated and taken out and the string suspension member 9 is disassembled to easily separate the string S from the string fastening device.

In addition, in the case where the string fastening device of the exemplary embodiment of the present invention is to be attached to various goods such as sneakers or clothes or gloves, the string S to be fastened or a separate mounting string is inserted into the fixation hole 1*d* provided on the flange portion 1*a* of the base 1 to be fixed to the product.

In the exemplary embodiment of the present invention, when the user intends to fix both end portions of the string S, the user may easily fix the string fastening device by pushing the both end portions into the hole 3*e* by holding the both end portions with the hand, and as a result, it is very convenient to use the string fastening device, thereby increasing the merchantability. In addition, in the case of a variety of products not equipped with the string fastening device, such as the shoes, the clothes, the gloves, and the like, there is an advantage that the string fastening device of the present invention may be easily installed and used.

Figure 7:
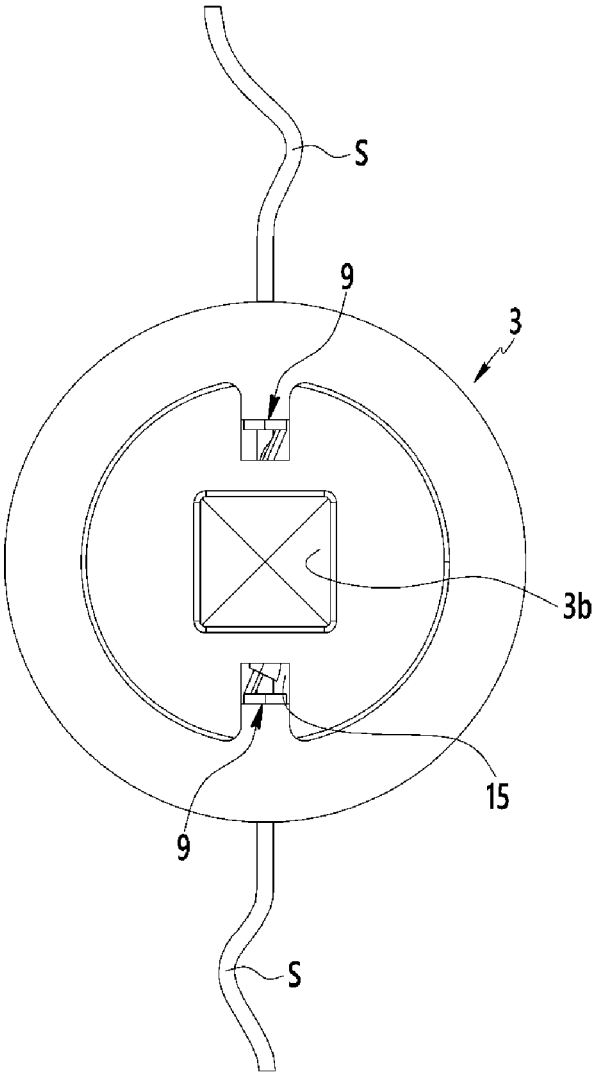
FIG. 7 is a plan view of a bobbin illustrating a second example of the exemplary embodiment of the present invention.
Figure 8:
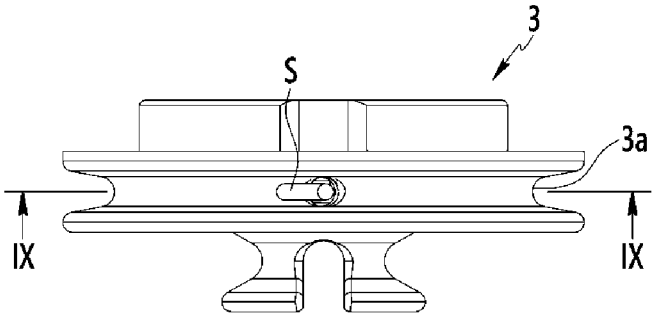
FIG. 8 is a front view of FIG. 7.
Figure 9:
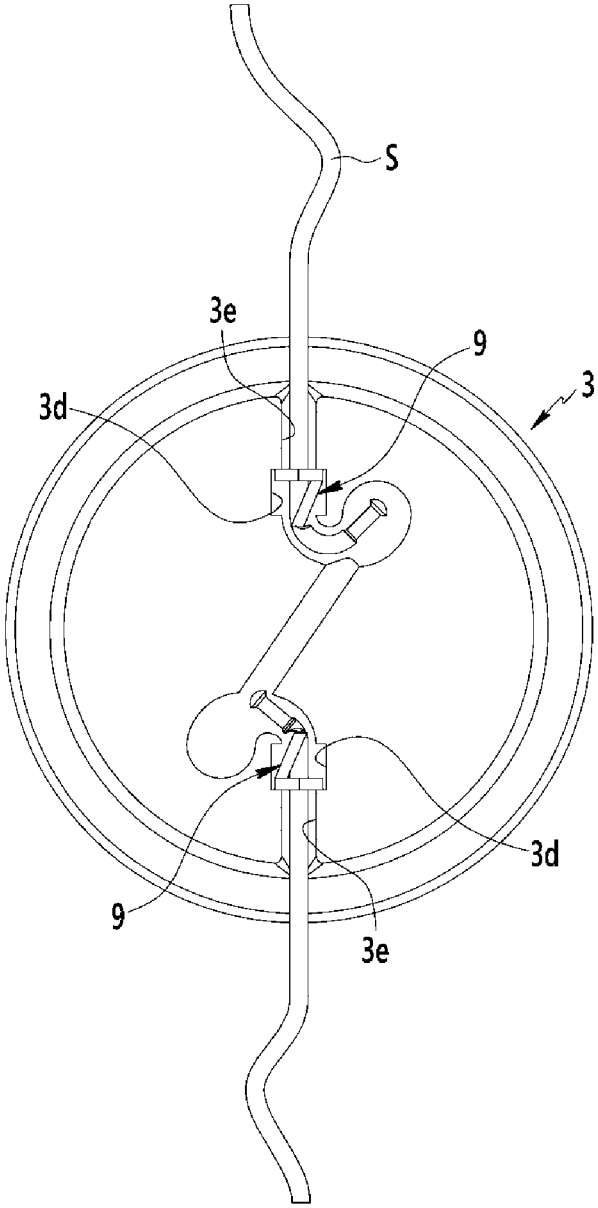
FIG. 9 is a cross-sectional view taken along line IX-IX of FIG. 8.
Figure 10:
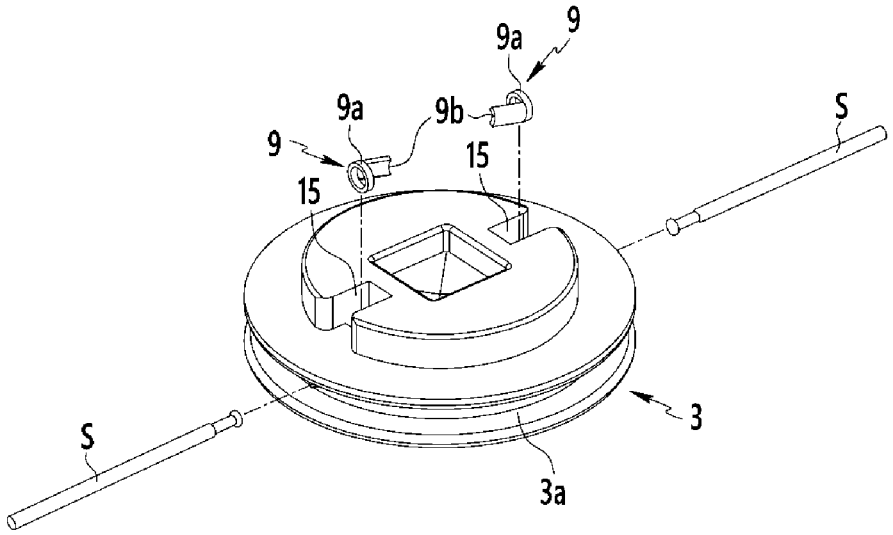
FIG. 10 is an exploded perspective view illustrating and disassembling a main part of FIG. 7.

FIGS. 7 and 10 are diagrams for describing a second example of the exemplary embodiment of the present invention and illustrate the bobbin 3 and the string suspension member 9. The description of the second example of the embodiment of the present invention is the same as the above description and is replaced with the description and only differences will be described. In the description of the second example of the exemplary embodiment of the present invention, constituent elements which perform the same or similar functions as those described above will be denoted by the same reference numerals and described.

In the first example of the exemplary embodiment, a structure in which the bobbin 3 is divided into the first member and the second member has been described, but in the second example of the embodiment of the present invention, the bobbin 3 may be integrally formed. Referring to FIGS. 7 and 10, the bobbin 3 may be provided with a string suspension member insertion hole 15 through which the string suspension member 9 may be inserted in a direction parallel to the axial direction. The string suspension member insertion hole 15 may be extended and connected to the insertion groove 3*d* of the bobbin 3. The second example of the exemplary embodiment of the present invention may be manufactured with a simple structure by reducing the number of components of the bobbin 3.

Figure 11:
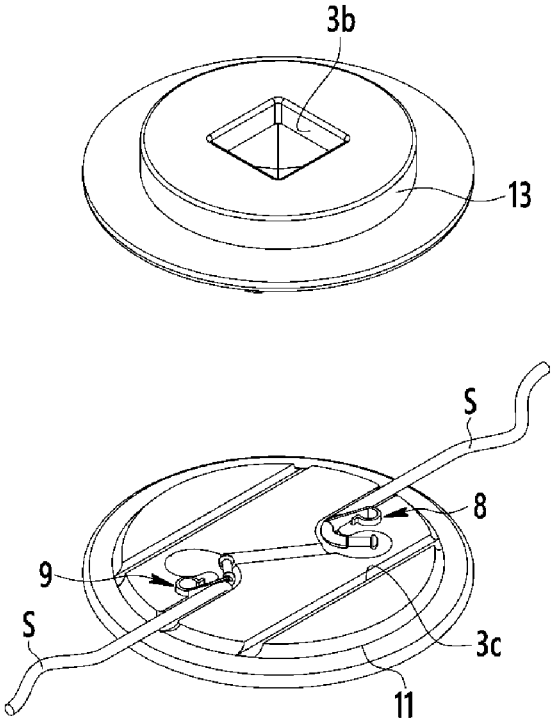
FIG. 11 is an exploded perspective view illustrating a bobbin of a third example of the exemplary embodiment of the present invention.
Figure 12:
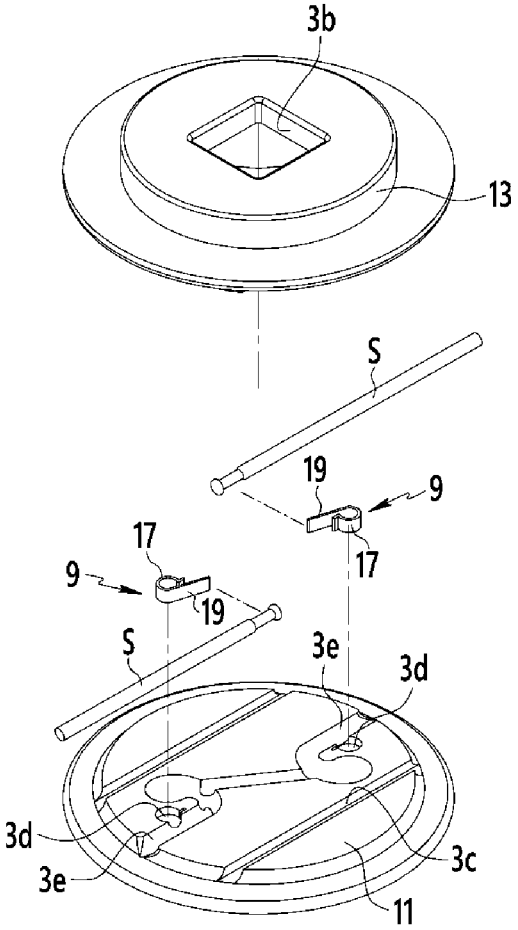
FIG. 12 is an exploded perspective view illustrating and disassembling a main part of FIG. 11.
Figure 13:
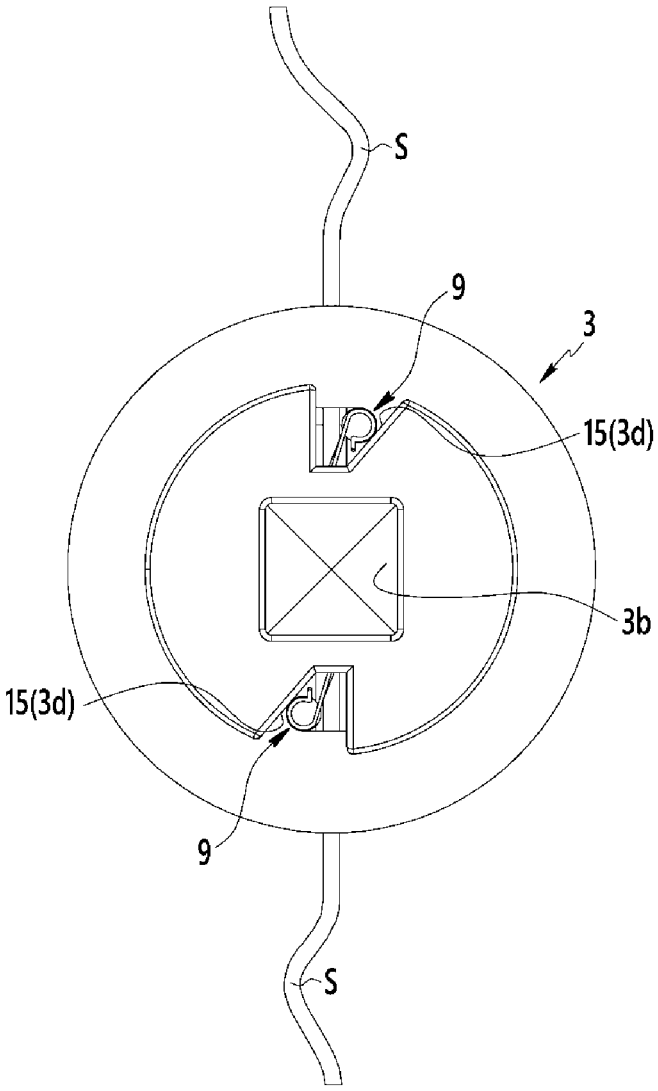
FIG. 13 is a plan view of a bobbin illustrating a fourth example of the exemplary embodiment of the present invention.
Figure 14:
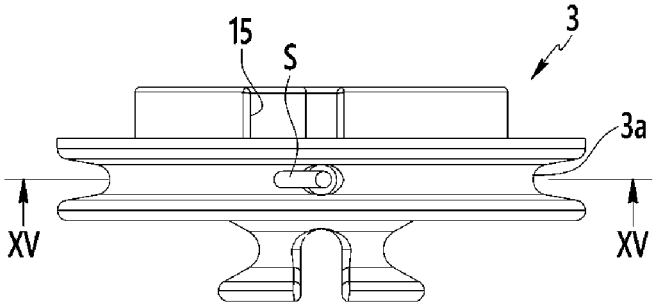
FIG. 14 is a front view of FIG. 13.
Figure 15:
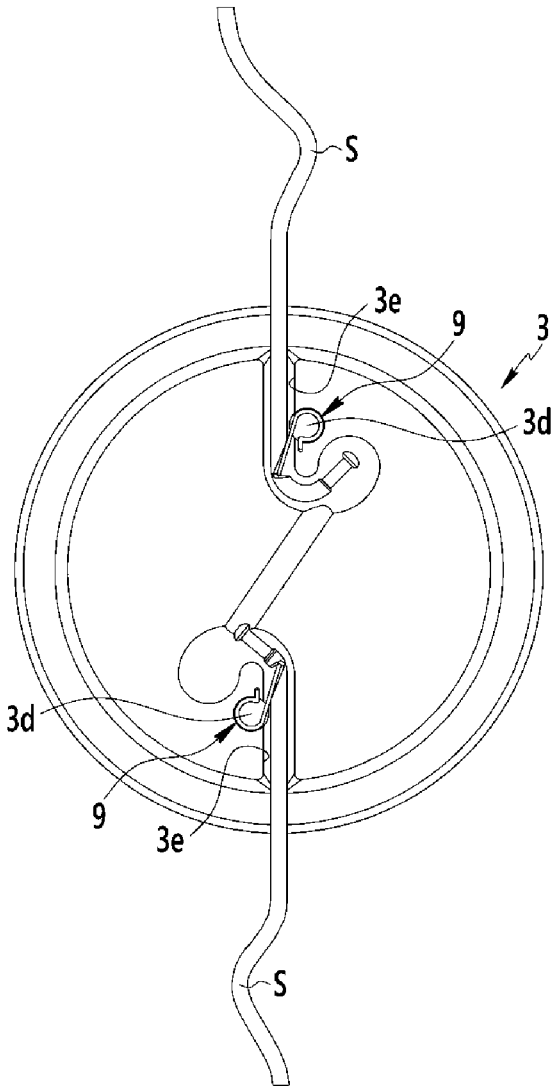
FIG. 15 is a cross-sectional view taken along line XV-XV of FIG. 14.
Figure 16:
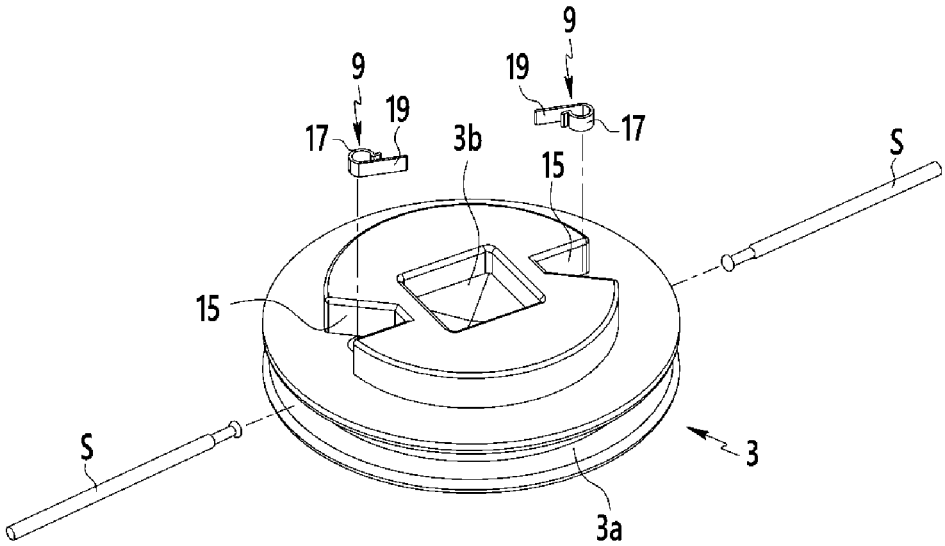
FIG. 16 is an exploded perspective view illustrating and disassembling a main part of FIG. 13.

FIGS. 11 and 12 are diagrams for describing a third example of the exemplary embodiment of the present invention and illustrate the bobbin 3 and the string suspension member 9. The third example of the exemplary embodiment of the present invention is different from the first example of the exemplary embodiment only in terms of the difference and is replaced with the description of the same or a held part. Further, components having the same or similar functions as the first example of the exemplary embodiment will be described with the same reference numerals for easy description.

The third example of the exemplary embodiment of the present invention differs from the first example of the exemplary embodiment in the shape of the string suspension member 9. That is, the string suspension member 9 of the third example of the exemplary embodiment of the present invention includes a location fixing portion 17 made of a band-like elastic body and a string attachment portion 19 also made of the band-like elastic body and extended from the location fixing portion 17. That is, in the location fixing portion 17 of the string suspension member 9 of the third example of the exemplary embodiment of the present invention, the band-like elastic body may have a substantially round shape and the location fixing portion 17 may form an extended free end, and the free end may form the string attachment portion 19. In the third example of the exemplary embodiment of the present invention, the string suspension member 9 makes it possible for the end portion of the string attachment portion 19, in which the band-like elastic body is rolled in a round shape to elastically support the side of the string S. The third example of the exemplary embodiment of the present invention may not only shows that the string suspension member 9 may be formed into various shapes including a bent V shape, a polygon, a curved ellipse, etc., but also reduce production cost by manufacturing the string suspension member 9 in a simpler structure. In this case, the band-like elastic body means an object including a part having the elasticity while the location fixing portion 17 or the string attachment portion 19 forms a band-like contour by bending or curving the leaf spring or the wire-formed line spring.

FIGS. 13 to 16 are diagrams for describing a fourth example of the exemplary embodiment of the present invention and illustrate the bobbin 3 and the string suspension member 9. Only the differences between the fourth example of the exemplary embodiment of the present invention and the example of the above exemplary embodiment are described and the description of the same part will be replaced with the above description. In addition, when the fourth example of the exemplary embodiment of the present invention has the same or similar constituent elements as the above exemplary embodiment, the same or similar constituent elements will be denoted by the same reference numerals and described.

When the fourth example of the exemplary embodiment of the present invention is compared with the third example, the fourth example is the same as the third example in technical contents and an operation principle, but the fourth example is different from the third example of the exemplary embodiment in that the bobbin 3 is integrally formed. That is, in the third example of the exemplary embodiment, the bobbin 3 is divided into two members and assembled, but in the fourth example of the exemplary embodiment of the present invention, the bobbin 3 may be formed by one member. The bobbin (3) may be provided with the string suspension member insertion hole 15 for fitting the string suspension member 9. The string suspension member insertion hole 15 may be provided in a direction parallel to the axis of the bobbin 3 as described in the second example of the exemplary embodiment and may be connected to the insertion groove 3*d*. The fourth example of the exemplary embodiment of the present invention also shows various examples of the exemplary embodiment and it is possible to reduce the number of components and manufacturing cost compared with the third example.

Figure 17:
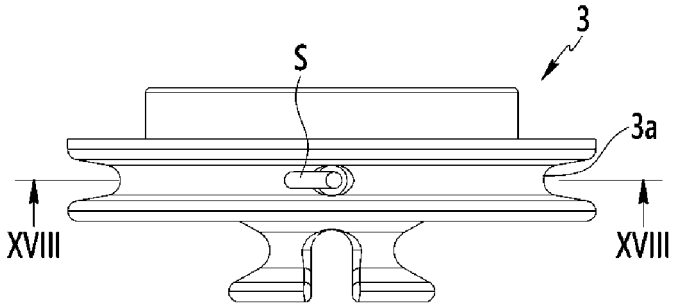
FIG. 17 is a plan view of a bobbin illustrating a fifth example of the exemplary embodiment of the present invention.
Figure 18:
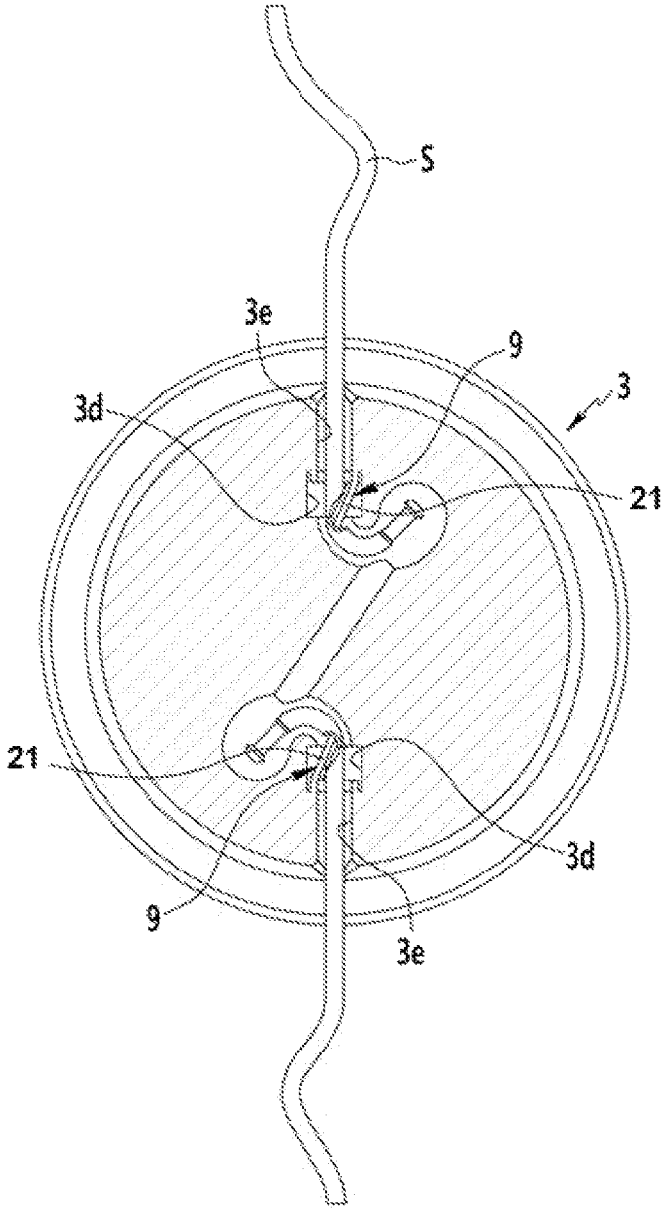
FIG. 18 is a cross-sectional view taken along line XVIII-XVIII of FIG. 17.

FIGS. 17 and 18 are diagrams for describing a fifth example of the exemplary embodiment of the present invention and illustrate the bobbin 3. Only the differences between the fifth example of the exemplary embodiment of the present invention and the example of the above exemplary embodiment are described and the description of the same part will be replaced with the above description. In addition, when the fifth example of the exemplary embodiment of the present invention has the same or similar constituent elements as the above exemplary embodiment, the same or similar constituent elements will be denoted by the same reference numerals and described.

The fifth example of the exemplary embodiment of the present invention differs from other examples of the exemplary embodiment in that the bobbin 3 and the string suspension member 9 are integrally molded. That is, in the fifth example of the exemplary embodiment of the present invention, a separate string attachment portion 21 is molded and manufactured integrally with the bobbin 3 in the hole 3*e* of the bobbin 3. In the string attachment portion 21 of the fifth example of the exemplary embodiment of the present invention, a kind of plate having the elasticity may be disposed to protrude obliquely toward the center side of the hole 3*e* from the inner wall surface of the hole 3*e*. Thus, the fifth example of the exemplary embodiment of the present invention is advantageous in that the object of the present invention may be achieved with a simpler structure.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A string fastening device comprising:

a base;

a bobbin received in the base;

a fixation member coupled to the base to maintain state in which the bobbin is stored in the base;

a rotational member coupled to the fixation member and rotating the bobbin; and a string suspension member provided in the bobbin and fixing a string, wherein the string suspension member comprises a string attachment portion having a shape of a cylindrically curved plate forming a valley, wherein the string is inserted along the valley of the string attachment portion, and wherein the string attachment portion urges the string by an elastic force toward a center line of a hole into which the string is inserted.

2. The string fastening device of claim 1, wherein:

the string suspension member is provided in the bobbin, wherein the string suspension member opens when the string is inserted, while the string suspension member maintains the string within the bobbin when the string stops moving.

3. The string fastening device of claim 1, wherein:

the string suspension member includes a first string suspension member and a second string suspension member which are disposed at individually at separate locations.

4. The string fastening device of claim 1, wherein:

in the bobbin, an insertion groove is provided in a radial direction based on a rotation center and the string suspension member is disposed in the insertion groove.

5. The string fastening device of claim 4, wherein:

the insertion groove is connected with the hole into which the string is inserted.

6. The string fastening device of claim 5, wherein:

the string suspension member includes a location fixing portion disposed in the bobbin, wherein the location fixing portion has a shape of a penetrated ring and is fixed in the insertion groove by an outer surface of the location fixing portion contacting to a surface of the insertion groove, and wherein the string attachment portion is extended from a rim of the location fixing portion.

7. The string fastening device of claim 6, wherein:

in the string attachment portion, when the string is inserted into the hole, an end portion of the string attachment portion moves in a direction away from a center line of the location fixing portion.

8. The string fastening device of claim 6, wherein:

wherein the bobbin has a string receiving groove extended from the insertion groove, and wherein the string receiving groove forms a curved space from the insertion groove.

9. The string fastening device of claim 6, wherein:

the string is inserted through the penetrated ring of the location fixing portion.

10. The string fastening device of claim 6, wherein:

the location fixing portion is made of an elastic body.

11. The string fastening device of claim 1, wherein:

the bobbin is divided into a first member and a second member, which are fitted and fixed to each other.

12. The string fastening device of claim 1, wherein:

between the fixation member and the rotational member, a one-direction rotational means in which the rotational member rotates in one direction is provided.

13. The string fastening device of claim 12, wherein:

the one-direction rotational means includes a first suspension portion provided in the fixation member, and a second suspension portion corresponding to the first suspension portion provided in the rotational member, and when the first suspension and the second suspension portion are in contact with each other, the rotational member rotatably moves only in one direction.

14. The string fastening device of claim 1, wherein:

in the fixation member, a first space portion partitioned by a suspension step and a second space portion adjacent to the first space portion and disposed in an axial direction are provided on an inner circumferential surface, and a suspension extension portion provided on an inner circumferential surface of the rotational member is fitted into the first or the second space portion.

15. The string fastening device of claim 14, wherein:

the suspension step is formed by coupling an elastic body to the fixation member.

16. The string fastening device of claim 1, wherein:

in the bobbin, a first coupling portion is provided, and a second coupling portion coupled to the first coupling portion and rotating the bobbin is provided in the rotational member.

17. The string fastening device of claim 16, wherein:

the first coupling portion and the second coupling portion are formed by a groove and a protrusion which are fitted to correspond to each other or formed by a spline shaft and a spline groove.

* * * * *